United States Patent [19]

Levasseur

[11] 4,316,532

[45] Feb. 23, 1982

[54] VERSATILE PRICING MEANS

[75] Inventor: Joseph L. Levasseur, Chesterfield, Mo.

[73] Assignee: H. R. Electronics Company, High Ridge, Mo.

[21] Appl. No.: 75,015

[22] Filed: Sep. 13, 1979

[51] Int. Cl.[3] ..... G07F 11/00

[52] U.S. Cl. ..... 194/1 N; 194/2; 194/10; 235/92 AC

[58] Field of Search ..... 194/1 R, 1 N, 2, 10; 133/2; 235/92 AC

[56] References Cited

U.S. PATENT DOCUMENTS

| | | | |
|---|---|---|---|
| 3,179,225 | 4/1965 | Murphy | 194/2 |
| 3,726,377 | 4/1973 | Nakayasa et al. | 194/10 |
| 3,806,711 | 4/1974 | Cousins | 235/92 AC |
| 3,869,032 | 3/1975 | Wheelwright et al. | 194/1 N |
| 4,034,839 | 7/1977 | Lee | 194/1N |

*Primary Examiner*—Joseph J. Rolla

*Attorney, Agent, or Firm*—Haverstock, Garrett & Roberts

[57] ABSTRACT

A pricing device for use in coin controlled and related devices such as coin changers and other vending control circuits including an electronic memory device for entering and storing price information, and programming controls for the memory device including information entry controls, memory addressing controls including controls for selecting a particular vend at a particular vend price, controls for addressing and storing in the memory device and for reading out therefrom selected vend price information, controls for disabling the memory entry controls during readout, and vend selection input and readout controls for the memory device.

21 Claims, 5 Drawing Figures fig 1.
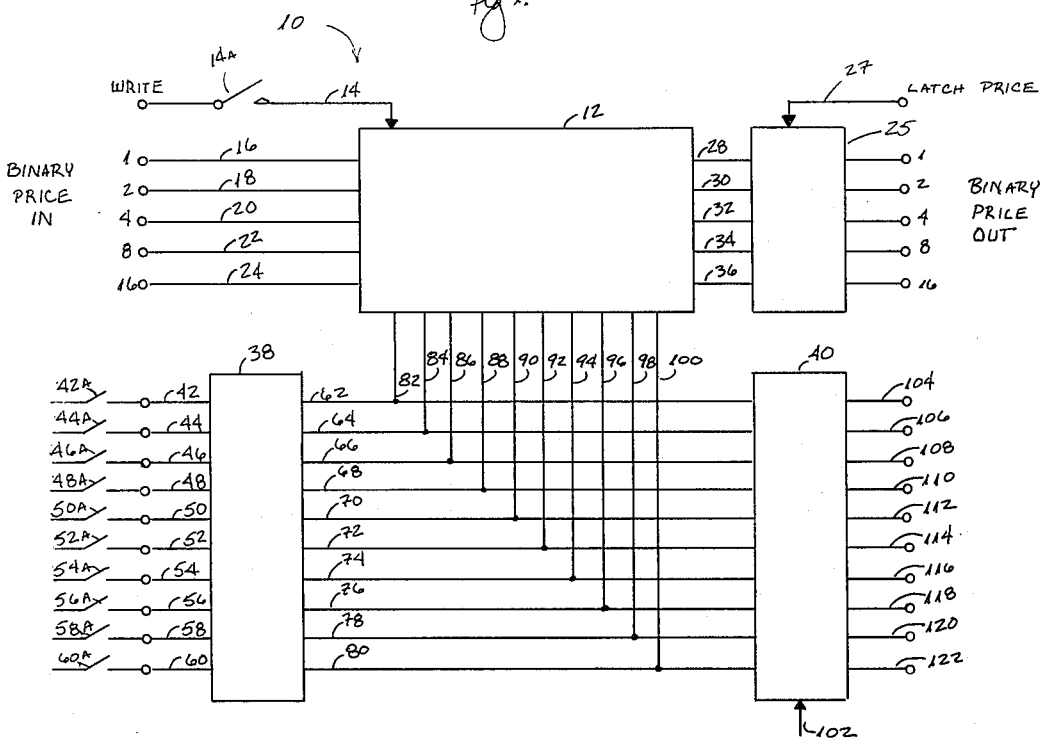
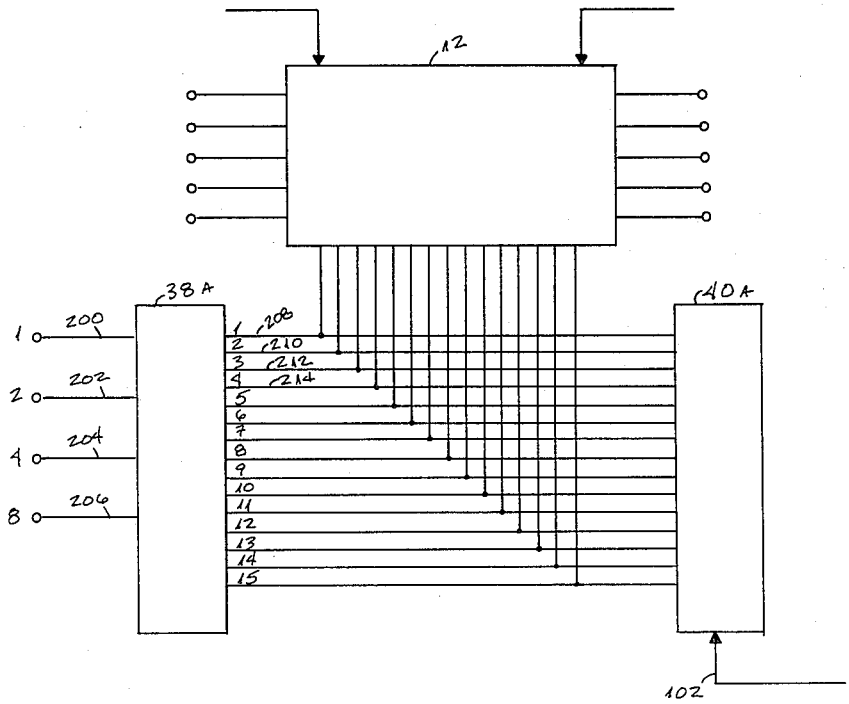
fig 2

VERSATILE PRICING MEANS

Figure 3:
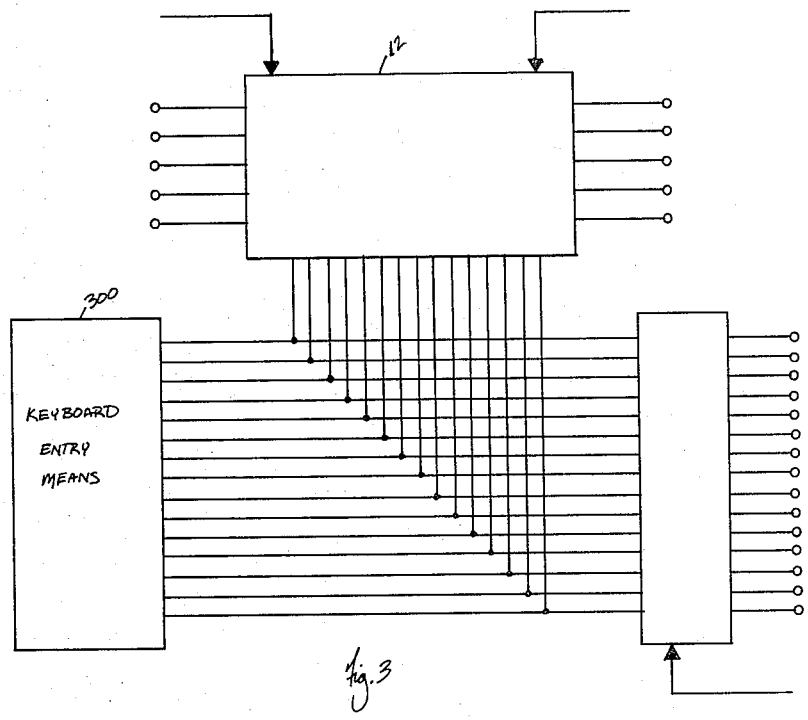

Various devices and means are known in the vending and related arts for providing price information, refund information, and change making information. This is true of vending devices and coin changers capable of single and multiple price and product selection and control. For the most part the known pricing means have included mechanical devices and switches, as well as diodes, transistors and other circuit elements and combinations thereof, and the known pricing devices have been relatively complicated, cumbersome, costly and bulky, and for these and other reasons have not been suitable for many applications, and the known means are also relatively unreliable, of limited versatility and trouble prone. Pricing devices which are mechanical or partially mechanical are also more likely to produce errors and require frequent maintenance. Furthermore, when a product and price selection is made using known pricing devices, only one product selection at one price can be indicated and noise problems caused by coin contact bounce and other undesirable characteristics must be carefully controlled and suppressed so that errors are not introduced. Another disadvantage of known pricing devices is their relatively limited possible vend price and product selection capabilities and the difficulty and the time required to change from one vend price or set of vend prices to another, not to mention the limited number of possible vends and vend prices that can be accommodated. The present construction overcomes these and other limitations, disadvantages and shortcomings of the known devices, and has the further advantage in that the present device can be made to be relatively small in size and compact, relatively inexpensive and troublefree, extremely reliable, it can be made to be versatile and easy to control, and it can be made to have almost unlimited storage and price capability.

It is therefore a principal object of the present invention to provide a relatively compact, trouble free, versatile, reliable and large capacity pricing device.

Another object is to provide a pricing device that can be read out at random.

Another object is to provide a pricing device that can be made to receive entry information for storage in serial or parallel form.

Another object is to provide a pricing device that can be programmed to readout stored information in series or parallel form.

Another object is to provide improved pricing means for use on vending and like devices.

Another object is to substantially enlarge the pricing and product selection capabilities of vending control circuits and devices.

Another object is to teach the circuit construction and of an improved pricing device.

Another object is to teach improved means for programming price and product information into a vend control circuit.

Another object is to make use of an electronic memory such as a read-write memory device to store price information in a vending control circuit.

Another object is to provide improved means to program a read-write random access memory device for use in providing pricing and product selection information.

Another object is to substantially enlarge the possible functions of vending and other money controlled devices.

Another object is to provide improved means to address access to a memory circuit for entry and readout functions.

These and other objects and advantages of the present invention will become apparent after considering the following detailed specification covering several embodiments of the present invention in conjunction with the accompanying drawings, wherein:

FIG. 1 is a block diagram of a pricing circuit constructed according to a preferred embodiment of the present invention; and FIGS. 2–5 are block diagrams showing other embodiments of controls for the subject pricing control circuit.

Referring to the drawings more particularly by reference numbers, number 10 identifies a pricing circuit incorporating the teachings of the present invention. The circuit 10 includes a read-write memory device 12 which has a plurality of input and output connections including control inputs and data inputs and outputs. The memory circuit control inputs include a write control input 14 on which a signal is present whenever data information is to be entered into the memory 12, and a plurality of data input connections 16–24 respectively labeled to represent the quantities 1, 2, 4, 8, and 16. These inputs are used for the entry of input information in binary word form. The inputs present on the input connections 16–24 are entered in the respective memory positions that are addressed and produce a binary word entry at these positions that represents a particular vend price. For example, a binary word for entering a nickel might be expressed as a high on input connection 16 and lows on input connections 18–24. In like manner, a binary word for entering 15 cents might be expressed as highs on binary input connections 16 and 18 and lows on connections 20–24. If a high is present only at binary input 20, 20 cents will be entered at the particular address, and so forth. A switch 14A such as might be operated by a serviceman, may be provided to control the write control input 14 so that prices can be changed or entered only by a serviceman.

The member 12 is connected to an output circuit 25 which is controlled by signals such as a latch price signal applied to input 27. The memory 12 has output connections 28, 30, 32, 34 and 36 and the binary word output present thereat will be communicated through the output circuit and/or retained therein under control of a signal present on the lead 27. When the output is fed through the circuit 25 it appears as a binary word on the leads labeled 1, 2, 4, 8, and 16 to represent the vend price as a binary word. The signals present on these connections depend upon amounts previously entered at a particular address, and the outputs for each different address represent a vend price. The number of entry positions or addresses in the memory circuit 12 determines the number of possible vend prices that can be stored and used at any time. In the circuit as shown the memory 12 has ten different addresses.

The circuit 10 also includes Selection In and Selection Out circuit portions 38 and 40, and these circuit portions are controlled and used to program and address the Read-Write memory 12 to cause desired vends and other operations to take place. The Selection In circuit 38 as shown in FIG. 1 has a plurality of input connections 42–60 which are connected to respective customer actuatable selection switches 42A–60A. The selection switches can have different forms but in their simplest form are grounded or are connected to some functional voltage such as to a positive or negative voltage source. Suitable mechanical or electrical interlocks can be provided to prevent more than one selection switch from being effective at any one time. Positions for ten possible selection switches are shown corresponding to the ten addresses of the memory 12. When a customer, having made an adequate deposit, depresses one of the selection switches 42A–60A, circuit means will be established to cause the desired vend to take place by addressing the proper address position in the memory and establishing other controls as will be explained.

The selection means included in circuit 38 may also include means to prevent a bouncing selection switch from introducing false entries, and it may include means to establish a priority selection condition depending on which of the selection switches is actuated. The circuit 38 as shown has ten input connections 42–60 and ten output connections 62–80. The output connections 62–80 are connected to respective inputs of the Selection Out circuit 40 and to respective address connections 82–100 of the memory 12.

The Selection Out circuit 40 may include a plurality of latching devices such as memory circuits, flip-flops, gate circuits or the like to receive corresponding outputs of the circuit 38 on the leads 62–80. The circuit 40 also receives initiate inputs on lead 102 which operate in combination with the particular outputs to produce outputs on corresponding leads 104–122 from the Selection Out circuit 40. These outputs are used to effect a vend operation or perform other functions. Various electronic devices can be used in the construction of the Selection Out circuit 40 including the use of transistors, SCRs, and other solid state gate circuit devices, to name a few possibilities.

The operation of the circuit 10 may have several different forms involving several operating modes. In one mode, a service or factory person such as a person who restocks or services a vending machine, can preset into the memory circuit 12 particular pricing information for different possible addresses that may be enabled by operation of one of the switches 42A–60A through the Selection In circuit 38. For example, with the circuit as shown having ten possible selection outputs from the circuit 38 on the connections 62–80, it is possible to enter ten different vend prices, one at each of the different addresses. The signal present on each of these connections can then be used to control the production of a different specific vend at a particular vend price. When the service person addresses a particular stage of the memory he can then enter into that address or stage any vend price he desires by controlling which of the binary price input leads 16–24 will have signals on them as explained above. For example a high on lead 16 represents a nickel, a high on lead 18 a dime, highs on leads 16 and 18 represent fifteen cents and so on, as aforesaid. Once a vend price is entered, thereafter when a selection is made by a customer pressing one of the selection switches such as the switch 42A associated with input lead 42 to the selection in circuit 38, the memory 12 will be addressed in its first stage by means of the input that is present on the lead 82. If the serviceman had actuated the selection switch 44A associated with the second memory address position on lead 44, which is connected to the memory 12 by lead 84, he can enter or change a previous entry for the second address position desired. The second address will thereafter be controlled by signals present on the address lead 84 when a customer actuates the switch 44A. This process can be repeated for each different address position of the memory 12 until a desired price has been entered into each. It is necessary when entering a vend price in each of the different address positions of the memory circuit 12 to also have a control or enable signal present on the write input lead 14. During vending, however, no such write control signal will be present for obvious reasons and signals on the lead 27 will control read-out. Later on, if the price at any one or more of the addresses is to be changed, the new price at the desired address can be read into the memory 12 in the same manner as before using the same procedure. After the memory 12 has been filled with the desired pricing information, the ircuit is ready to be used in the control of the operation of a vending machine.

In order for the vending machine to be operated, the customer, after making a deposit, will actuate the desired selection switch 42A–60A depending upon the product he desires to purchase. Any particular switch the customer actuates corresponds respectively to, or is the same as, one of the selection switches 42A–60A that the serviceman used to program the pricing information in the memory 12. When the customer depresses a desired selection switch, a signal will be present on the corresponding input and output of the Selection In circuit 38 to address the corresponding address of the read-write memory circuit 12 as stated and also to produce a corresponding input to the circuit portion 40. During vending the read-write memory 12 will also receive control inputs on the latch price input lead 27 to cause the price entered in the address portion of the memory to read out on the corresponding binary price output leads 28–36. The amount appearing on these leads will represent the same amount or price stored at that selected address of the memory 12. This amount, in binary form, is applied to means in the coin changer circuit which will compare it to the amount deposited by the customer in the coin receiving unit. Vend control circuits typical of the types capable of receiving and using such information are disclosed in U.S. Pat. Nos. 3,841,456; 3,894,220 and 4,008,792, all assigned to applicant's assignee.

If an amount deposited at least equals the amount appearing on the binary price output leads 28–36, a vend signal, and in some cases refund signals, will be established in the vend control circuit. The vend signal will also cause a signal to be present on enable and latch input 102 of the Selection Out circuit 40, and this signal in combination with the signal present on the selected one of the leads 62–80, which corresponds to the selection switch actuated by the customer, will operate selected ones of the gate circuits in the circuit 40 to produce outputs on certain of leads 104–122. The signals on these leads may be used to effect a desired vend operation or do some other operation. Other means in the changer circuit, not part of this invention, will produce a refund operation, if necessary. With the circuit as shown in FIG. 1 it is possible to establish ten different vends, each of which can have the same or a different vend price ranging from a low vend price in the circuit as shown of 5 cents to a high possible vend price of $1.55. Greater capacity can also be provided as required by increasing the number of binary input and output connections thereto. It is also possible to change the vend price for each of the different vends in the simple easy to operate manner already described. The advantages of the flexibility and versatility in price and in controlling a vending machine using the present relatively simple pricing circuit are readily apparent.

FIG. 2 shows a variation of the pricing circuit of FIG. 1 wherein a modified form of the selection input circuit 38A is employed. The circuit 38A has its input constructed to receive information in binary form and has an expanded number of outputs, rather than having a one-to-one relationship between the inputs and outputs as in the FIG. 1 construction. For example, the inputs to the circuit 38A are shown applied on four input leads 200, 202, 204, and 206. The input lead 200 represents a binary "1", the input lead 202 a binary "2", the input lead 204 a binary "4", and the input lead 206 a binary "8". The circuit 38A, like the circuit 38, may also include debounce circuitry similar to that disclosed in U.S. Pat. No. 3,307,671, priority selection circuitry similar to that shown in U.S. Pat. No. 3,828,903, and code circuitry which expands the number of possible outputs depending on the number of possible combinations of the inputs. With four binary inputs as shown, it is possible to obtain fifteen different outputs. This can be understood by considering that an input on input lead 200 may be used to produce an output address response on output lead 208, an input on lead 202 will produce an address response on output lead 210, inputs simultaneously present on input leads 200 and 202 will produce an output on lead 212, an input only on lead 204 will produce an address response on lead 214, and so forth. It is therefore possible with the circuit as shown in FIG. 2 to use only four selection inputs in binary form to address a read-write memory circuit such as the circuit 12A at fifteen different possible addresses. Except for this feature of the construction of FIG. 2, it may be otherwise similar in construction and operation to the circuit shown in FIG. 1.

FIG. 3 shows another embodiment of the subject circuit wherein the selection input circuit has been replaced by keyboard entry means 300. The keyboard entry means 300 is shown having fifteen output leads which represent fifteen possible addresses. The keyboard may have keys for each possible address and it may use an electronic strobe to electronically scan a sensitive surface to produce desired outputs depending upon which of the keys or similar means is touched or otherwise actuated. Except for the fact that the circuit of FIG. 3 includes the keyboard entry means 300 instead of selection switches or binary inputs as disclosed in FIGS. 1 and 2, the circuit of FIG. 3 is similar structurally and operationally to the circuits of FIGS. 1 and 2.

Figure 4:
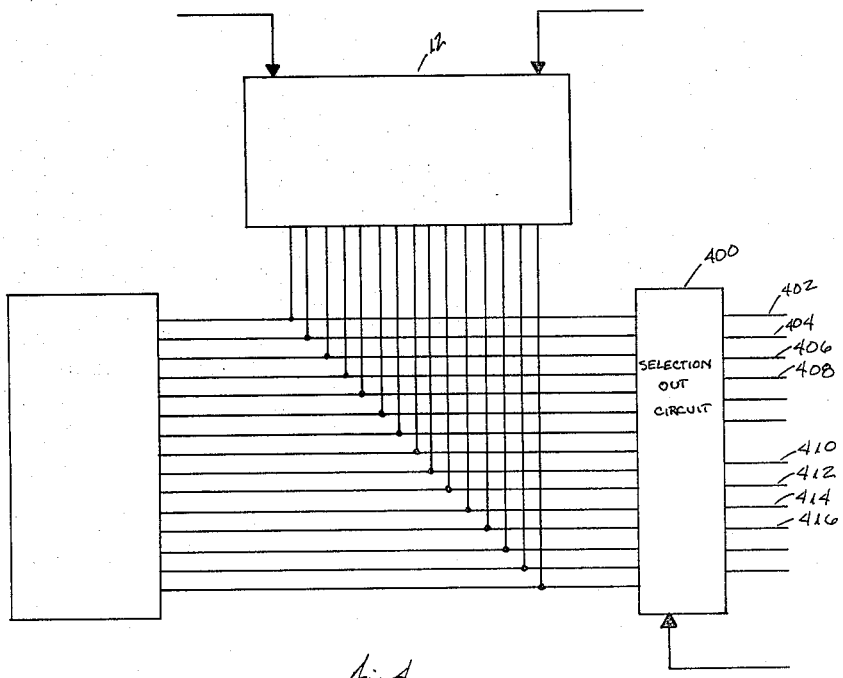

FIG. 4 shows another embodiment of the subject pricing circuit. The pricing circuit of FIG. 4 is similar to that of FIG. 3 in that is uses keyboard entry means. The inputs, outputs and control connections to the read-write memory employed are also similar to those shown in FIGS. 1–3. The difference between the construction shown in FIG. 4 and the other constructions resides mainly in the construction of the Selection Out circuit portion 400 which has a plurality of outputs leads 402–416. The outputs 402–408 are X outputs and the outputs 410–416 are Y outputs. When outputs are present on selected ones of the X and Y outputs they combine to establish a desired output condition. These outputs can be applied to a memory circuit similar to the pricing circuit 12 and used to control the vending and other functions. The purposes and operation of the circuit of FIG. 4 may be similar to those for the other embodiments.

Figure 5:
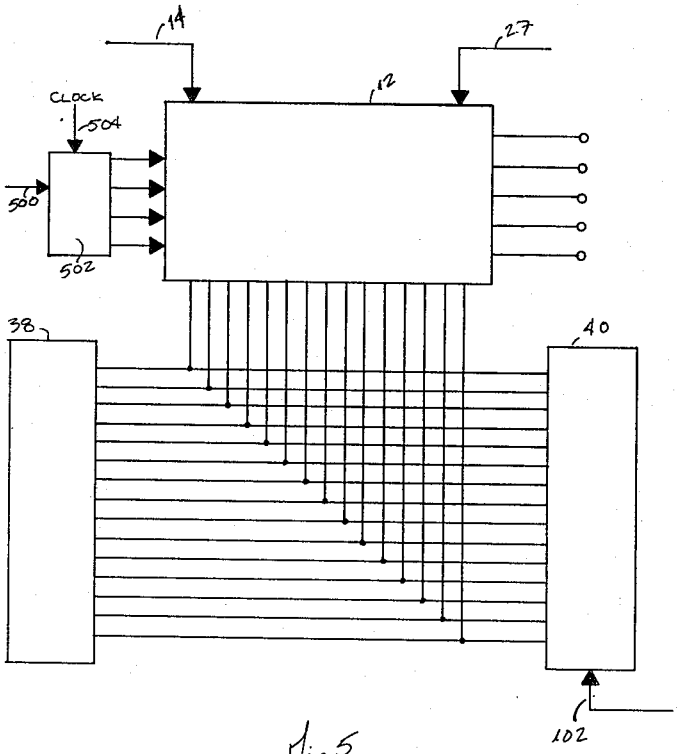

The circuit embodiment of FIG. 5 is also similar to the other embodiments such as that of FIG. 1, the main difference being that the price entry to the read-write memory 12 in the FIG. 5 construction is a series bit price entry 500 rather than a parallel bit entry. A series bit entry may require coding of the input bit train by some known encoding technique but otherwise does not effect the construction or operation. A shift register 502 with a clock input 504 and a parallel feed ouput may be used in this construction.

In order to operate the constructions shown to perform a vending operation once the pricing information has been entered, as aforesaid, it is necessary to address the read-write memory 12 using the selection input means to the circuit 38 or to select a particular address or stage of the memory. When the memory is addressed and a deposit at least equal to the selected vend price has been made, circuit means will produce a suitable response on the latch price control entry 26 so that vend price at the particular address will read out to cause the desired vend and other functions to take place. This process can be repeated for each different address and for each different vend price programmed into the memory 12 thereby providing a wide range of price and product selection capability.

The use of electronic memories of the type described for storing price information has distinct advantages in size, cost, versatility and relability over other known types of pricing devices such as those using various electrical and mechanical switches, diodes and other like devices. The present device also provides the capability of random read out without loss of pricing information. The Selection Out circuit portion 40 can likewise be controlled by a signal on the enable and latch input 102. Similar controls are available in all embodiments of the present device.

Certain circuit functions can be enabled or prevented under control of switches or other controls that are available to service and maintenance personnel. For example, the selection information can be supplied by switches such as pushbutton switches or keys on a keyboard operated by a serviceman and by a customer. However, when the serviceman is entering prices into the pricing device he is erasing previously entered prices which is not so when the customer is operating the device. The subject circuit therefore greatly expands the price and product selectivity of known vending machines and makes it possible to quickly and easily change the prices of any desired number of product thereby making it relatively easy for the vending industry to keep up with price changes without effecting major circuit changes. The write and latch inputs 14 and 27 to the memory circuit 12 can also be controlled by door switches or other interlocks on the vending machine so that price changes can only be effected when the vending machine door is open and a read out from the memory can only be effected when the door is closed.

Thus there has been shown and described novel versatile pricing means which fulfill all of the objects and advantages sought therefor. It will be apparent to those skilled in the art, however, that many changes, modifications, alterations, and other uses and applications for the subject pricing means are possible including the various modifications described herein. All such changes, modifications, alterations, and other uses and applications which do not depart from the spirit and scope of the invention are deemed to be covered by the invention which is limited only by the claims which follow.

What is claimed is:

1. A price control circuit for vending and like devices having actuatable vend selection means, credit entry means, vend delivery means for delivering vend selections, each vend selection having vend delivery means associated therewith, and means for generating a price retrieval signal and for producing a vend initiation signal when the amount of credit entered at least equals the price of a selected vend, comprising a read-write memory having a plurality of address locations where price information can be stored for later readout, control means for the memory including price entry connection means, price readout connection means, write control connection means, readout control connection means, and a plurality of memory address control connections operatively connected to respective ones of the address locations, means for producing price information in binary form for entry into the memory, said means being operatively connected to the price entry connection means, means, including addressing signal outputs, responsive to actuations of the vend selection means for producing addressing information at said addressing signal outputs, the addressing signal outputs being connected to the memory address control connections for establishing a particular address location in the memory for respective entry thereinto or readout therefrom of price information, means to apply a control response to the write control connection means at a time when a memory address has been selected to effect entry of the pricing information present on the price entry connection means into memory at the selected address location, means responsive to generation of a price retrieval signal to apply a control response to the readout control connection means to effect readout of a previously entered price from a selected address location, and means, including first input means operatively connected to the addressing signal outputs and second input means operatively connected to receive the vend initiation signals, responsive to vend initiation signals to effect operation of the vend delivery means associated with the vend selection that has been selected.

2. The price control circuit defined in claim 1 wherein the means for producing pricing information in binary form includes means for producing price information in parallel bit form.

3. The price control circuit of claim 1 wherein the means for producing pricing information in binary form include means for producing pricing information in serial bit form.

4. The price control circuit defined in claim 1 wherein the readout control connection means include means for reading out price information from the read-write memory in parallel bit form.

5. The price control circuit defined in claim 1 wherein the readout control connection means includes means for reading out price information from the read-write memory in serial bit form.

6. The price control circuit defined in claim 1 wherein each address location of the read-write memory includes a plurality of storage positions each capable of storing one binary bit.

7. A pricing control circuit for vending and like devices having actuatable vend selection means, credit entry means, vend delivery means for delivering vend selections, each vend selection having vend delivery means associated therewith, and means for generating a price retrieval signal and for producing a vend initiation signal when the amount of credit entered at least equals the price of a selected vend, comprising an electronic memory circuit of matrix construction having a plurality of multi-position addresses each capable of storing a vend price in binary bit form, a price information means operatively connected to the memory circuit for generating a pricing signal, memory entry control means including means for selectively individually accessing said addresses for entering therein a binary word corresponding to a pricing signal generated by said price information means, said memory entry control means including write means to enable the entering of a binary word into a selected address, memory readout control means for reading out a binary word previously entered in a selected one of the multi-position addresses, said memory readout control means including means to access the address to be read out and means to enable readout therefrom, the same address accessing means being used with the memory entry control means for entering a binary word at a particular address as are used with the memory readout control means for reading out a binary word, said address accessing means, including addressing signal outputs, being responsive to actuations of the vend selection means for producing addressing information at said addressing signal outputs, the condition of the addressing signal outputs establishing the particular memory address for access, said memory entry control means including means to effect entry at the memory address accessed of a binary word corresponding to the pricing signal generated by said price information means, said address accessing means including means, having first input means operatively connected to the addressing signal outputs and second input means operatively connected to receive a vend initiation signal, responsive to a vend initiation signal to effect operation of the vend delivery means associated with the vend selection that has been selected.

8. The control circuit of claim 7 wherein the memory circuit is arranged to have a plurality of interconnected rows and columns of entry positions, each row of entry positions corresponding to a different position of a binary word to be entered therein, and each column corresponding to an address position for a different binary word.

9. The control circuit of claim 7 wherein each addressing signal output of the address accessing means corresponds to a respective address of the memory circuit.

10. The control circuit of claim 7 wherein the address accessing means includes an input circuit having a plurality of input connections corresponding to different respective positions of a binary word, information being produced on said input connections in response to actuation of the vend selection means, the information produced on said addressing signal outputs being a Boolean function of the information on said input connections.

11. A pricing device for use with vending and like devices having actuatable vend selection means, credit entry means, vend delivery means for delivering vend selections, each vend selection having vend delivery means associated therewith, and means for generating a price retrieval signal and for producing a vend initiation signal when the amount of credit entered at least equals the price of a selected vend, comprising an electronic memory device for entering and storing price information, said electronic memory device having a plurality of addresses each of which includes a plurality of bistable elements the combined conditions of at least some of which represent a price, programming control means operatively connected to the memory device including price information entry control means for establishing a price entry, memory entry control means to enable entry of a price into a particular memory address from the price information entry control means, said programming control means being operable to replace previously stored price information at each of the particular memory addresses, memory readout control means including readout enable means to control the readout of pricing information, and memory addressing control means for selecting a particular address for access, said memory addressing control means, including addressing signal outputs, being responsive to actuations of the vend selection means for producing addressing information at said addressing signal outputs, the condition of the addressing signal outputs establishing the particular memory address for access, said memory entry control means including means to effect entry of said price entry into the memory device at the memory address accessed, said readout control means being responsive to generation of a price retrieval signal to effect readout of a price from the memory address accessed, and means, including first input means operatively connected to the addressing signal outputs and second input means operatively connected to receive the vend initiation signals, responsive to vend initiation signals to effect operation of the vend delivery means associated with the vend selection that has been selected.

12. A pricing device for use with vending and like devices having actuatable vend selection means, credit entry means, vend delivery means for delivering vend selections, each vend selection having vend delivering means associated therewith, and means for generating a price retrieval signal and for producing a vend initiation signal when the amount of credit entered at least equals the price of a selected vend, comprising an electronic memory device for entering and storing price information, said electronic memory device having a plurality of addresses each of which includes a plurality of bistable elements the combined conditions of at least some of which represent a price, programming control means operatively connected to the memory device including price information entry control means for establishing a price entry, memory entry control means to enable entry of a price into a particular memory address from the price information entry control means, said programming control means being operable to replace previously stored price information at each of the particular memory addresses, memory readout control means including readout enable means, including an input, to control the readout of pricing information, and memory addressing control means separate from said input of said memory readout enable means for selecting a particular address for access, said memory addressing control means, including addressing signal outputs, being responsive to actuations of the vend selection means for producing addressing information at said addressing signal outputs, the condition of the addressing signal outputs establishing the particular memory address for access, said memory entry control means including means to effect entry of said price entry into the memory device at the memory address accessed, said readout control means being responsive to generation of a price retrieval signal to effect readout of a price from the memory address accessed, and means operatively connected to the addressing signal outputs and responsive to vend initiation signals to effect operation of the vend delivery means associated with the vend selection that has been selected.

13. A pricing device for use with vending and like devices having actuatable vend selection means, credit entry means, vend delivery means for delivering vend selections, each vend selection having vend delivery means associated therewith, and means for generating a price retrieval signal and for producing a vend initiation signal when the amount of credit entered at least equals the price of a selected vend, comprising an electronic memory device for entering and storing price information, said electronic memory device having a plurality of addresses each of which includes a plurality of bistable elements the combined conditions of at least some of which represent a price, programming control means operatively connected to the memory device including price information entry control means for establishing a price entry, memory entry control means to enable entry of a price into a particular memory address from the price information entry control means, said programming control means being operable to replace previously stored price information at each of the particular memory addresses, memory readout control means including readout enable means to control the readout of pricing information, and memory addressing control means for selecting a particular address for access, said memory addressing control means, including addressing signal outputs, being responsive to actuations of the vend selection means for producing addressing information at said addressing signal outputs, the condition of the addressing signal outputs establishing the particular memory address for access, said memory entry control means including means operative in response to actions by authorized personnel at a time when a particular memory address has already been established at said addressing signal outputs to effect entry of said price entry into the memory device at the memory address accessed, said readout control means being responsive to generation of a price retrieval signal to effect readout of a price from the memory address accessed, and means operatively connected to the addressing signal outputs and responsive to vend initiation signals to effect operation of the vend delivery means associated with the vend selection that has been selected.

14. The pricing device of claims 11, 12, or 13 including servicing means operable authorized personnel, said readout control means being responsive to operation of said servicing means.

15. The pricing device of claims 11, 12, or 13 including servicing means operable by authorized personnel, said means to effect entry of said price entry into the memory device at the memory address accessed being responsive to operation of said servicing means.

16. The pricing device of claim 15 wherein said servicing means is operable by authorized personnel to effect production of addressing information at said addressing signal outputs.

17. The pricing device of claim 16 wherein said servicing means includes a keyboard entry means.

18. A price control circuit for vending and like devices having actuatable vend selection means, credit entry means, vend delivery means for delivering vend selections, each vend selection having vend delivery means associated therewith, and means for generating a price retrieval signal and for producing a vend initiation signal when the amount of credit entered at least equals the price of a selected vend, comprising a read-write memory having a plurality of address locations where price information can be stored for later readout, control means for the memory including price entry connection means, price readout connection means, write control connection means, readout control connection means, and a plurality of memory address control connections operatively connected to respective ones of the address locations, said readout control connection means including an input separate from said address control connections, means for producing price information in binary form for entry into the memory, said means being operatively connected to the price entry connection means, means, including addressing signal outputs, responsive to actuations of the vend selection means for producing addressing information at said addressing signal outputs, the addressing signal outputs being connected to the memory address control connections for establishing a particular address location in the memory for respective entry thereinto or readout therefrom of price information, means to apply a control response to the write control connection means at a time when a memory address has been selected to effect entry of the pricing information present on the price entry connection means into memory at the selected address location, means responsive to generation of a price retrieval signal to apply a control response to the readout control connection means to effect readout of a previously entered price from a selected address location, and means operatively connected to the addressing signal output and responsive to vend initiation signals to effect operation of the vend delivery means associated with the vend selection that has been selected.

19. A pricing control circuit for vending and like devices having actuatable vend selection means, credit entry means, vend delivery means for delivering vend selections, each vend selection having vend delivery means associated therewith, and means for generating a price retrieval signal and for producing a vend initiation signal when the amount of credit entered at least equals the price of a selected vend, comprising an electronic memory circuit of matrix construction having a plurality of multi-position addresses each capable of storing a vend price in binary bit form, a price information means operatively connected to the memory circuit for generating a pricing signal, memory entry control means including means for selectively individually accessing said addresses for entering therein a binary word corresponding to a pricing signal generated by said price information means, said memory entry control means including write means to enable the entering of a binary word into a selected address, memory readout control means for reading out a binary word previously entered in a selected one of the multiposition addresses, said memory readout control means including means to access the address to be read out and means, including an input, to enable readout therefrom, said input of said readout enabling means being separate from said address accessing means, the same address accessing means being used with the memory entry control means for entering a binary word at a particular address as are used with the memory readout control means for reading out a binary word, said address accessing means, including addressing signal outputs, being responsive to actuations of the vend selection means for producing addressing information at said addressing signal outputs, the condition of the addressing signal outputs establishing the particular memory address for access, said memory entry control means including means to effect entry at the memory address accessed of a binary word corresponding to the pricing signal generated by said price information means, said address accessing means including means operatively connected to the addressing signal outputs and responsive to a vend initiation signal to effect operation of the vend delivery means associated with the vend selection that has been selected.

20. A price control circuit for vending and like devices having actuatable vend selection means, credit entry means, vend delivery means for delivering vend selections, each vend selection having vend delivery means associated therewith, and means for generating a price retrieval signal and for producing a vend initiation signal when the amount of credit entered at least equals the price of a selected vend, comprising a read-write memory having a plurality of address locations where price information can be stored for later readout, control means for the memory including price entry connection means, price readout connection means, write control connection means, readout control connection means, and a plurality of memory address control connections operatively connected to respective ones of the address locations, means for producing price information in binary form for entry into the memory, said means being operatively connected to the price entry connection means, means, including addressing signal outputs, responsive to actuations of the vend selection means for producing addressing information at said addressing signal outputs, the addressing signal outputs being connected to the memory address control connections for establishing a particular address location in the memory for respective entry thereinto or readout therefrom of price information, means operative in response to actions by authorized personnel to apply a control response to the write control connection means at a time when a memory address has already been selected to effect entry of the pricing information present on the price entry connection means into memory at the selected address location, means responsive to generation of a price retrieval signal to apply a control response to the readout control connection means to effect readout of a previously entered price from a selected address location, and means operatively connected to the addressing signal outputs and responsive to vend initiation signals to effect operation of the vend delivery means associated with the vend selection that has been selected.

21. A pricing control circuit for vending and like devices having actuatable vend selection means, credit entry means, vend delivery means for delivery vend selections, each vend selection having vend delivery means associated therewith, and means for generating a price retrieval signal and for producing a vend initiation signal when the amount of credit entered at least equals the price of a selected vend, comprising an electronic memory circuit of matrix construction having a plurality of multi-position addresses each capable of storing a vend price in binary bit form, a price information means operatively connected to the memory circuit for generating a pricing signal, memory entry control means including means for selectively individually accessing said addresses for entering therein a binary word corresponding to a pricing signal generated by said price information means, said memory entry control means including write means to enable the entering of a binary word into a selected address, memory readout control means for reading out a binary word previously entered in a selected one of the multi-position addresses, said memory readout control means including means to access the address to be read out and means to enable readout therefrom, the same address accessing means being used with the memory entry control means for entering a binary word at a particular address as are used with the memory readout control means for reading out a binary word, said address accessing means, including addressing signal outputs, being responsive to actuations of the vend selection means for producing addressing information at said addressing signal outputs, the condition of the addressing signal outputs establishing the particular memory address for access, said memory entry control means including means operative in response to actions by authorized personnel at a time when a particular memory address has already been established at said addressing signal outputs to effect entry at the memory address accessed of a binary word corresponding to the pricing signal generated by said price information means, said address accessing means including means operatively connected to the addressing signal outputs and responsive to a vend initiation signal to effect operation of the vend delivery means associated with the vend selection that has been selected.

* * * * *

UNITED STATES PATENT OFFICE

CERTIFICATE OF CORRECTION

Patent No. 4,316,532 Dated February 23, 1982

Inventor(s) Joseph L. Levasseur

It is certified that error appears in the above-identified patent and that said Letters Patent are hereby corrected as shown below:

Column 4, line 17, "ircuit" should be --- circuit ---.

Column 5, line 61, "outputs" should be --- output ---.

Column 13, line 9, "delivery" (second occurrence) should by --- delivering ---.

Signed and Sealed this

*Fifteenth* Day of *June 1982*

[SEAL]

*Attest:*

GERALD J. MOSSINGHOFF

*Attesting Officer* *Commissioner of Patents and Trademarks*